US005247782A

United States Patent [19]

Rejsa

[11] Patent Number: 5,247,782

[45] Date of Patent: Sep. 28, 1993

[54] DOUGH CUTTING AND PACKING APPARATUS

[75] Inventor: Jack J. Rejsa, Plymouth, Minn.

[73] Assignee: The Pillsbury Company, Minneapolis, Minn.

[21] Appl. No.: 971,735

[22] Filed: Nov. 4, 1992

[51] Int. Cl.[5] ..... B65B 63/00; B65B 65/02

[52] U.S. Cl. ..... 53/516; 53/244; 53/252; 53/258; 53/520

[58] Field of Search ..... 53/516, 514, 513, 518, 53/519, 520, 252, 251, 250, 249, 258, 244

[56] References Cited

U.S. PATENT DOCUMENTS

| | | | |
|---|---|---|---|
| 3,065,584 | 11/1962 | Coleman | 53/516 X |
| 3,154,986 | 11/1964 | Reid | 53/516 X |
| 3,273,300 | 9/1966 | Watrous et al. | 53/516 X |
| 3,339,335 | 9/1967 | Bowden | 53/516 |
| 3,427,783 | 2/1969 | Reid | 53/516 |
| 3,933,068 | 1/1976 | Rejsa | 53/516 |
| 4,085,563 | 4/1978 | Egee et al. | 53/250 X |
| 4,506,488 | 3/1985 | Matt et al. | 53/55 |
| 4,722,169 | 2/1988 | DeSantis | 53/494 |
| 5,029,431 | 7/1991 | Weening et al. | 53/437 |

*Primary Examiner*—James F. Coan

*Attorney, Agent, or Firm*—Kinney & Lange

[57] ABSTRACT

A dough cutting and packing apparatus for cutting a sheet of dough into dough pieces and transferring the dough pieces to containers. A cutting unit is defined by a plurality of cutting plates having dough retaining openings. The sheet of dough is pressed against the cutting plates by a presser roll which divides the dough sheet into dough pieces that are retained within the dough retaining openings. A packing mechanism transfers the dough pieces from the cutting unit to the containers as the containers are moved relative to the packing mechanism by a plurality of flighted augers. The packing mechanism is driven by a microprocessor controlled servo motor. The servo motor moves the packing mechanism through a packing stroke and a return stroke with each stroke having an acceleration stage and a deceleration stage.

12 Claims, 3 Drawing Sheets

DOUGH CUTTING AND PACKING APPARATUS

BACKGROUND OF THE INVENTION

The invention relates generally to dough cutting and packing devices. In particular, the present invention is a dough cutting and packing device having a packing mechanism capable of transferring pieces of dough from a dough sheet to containers at a high rate of speed.

Devices for cutting a sheet of dough into pieces and packing the dough pieces into containers are generally known. U.S. Pat. No. 3,427,783 to Reid, which is incorporated herein by reference, discloses one such dough cutting and packing apparatus. The cutting and packing apparatus of Reid includes an endless cutting unit formed by a plurality of interconnected cutting plates. A sheet of dough enters the cutting and packing apparatus at a first end of the cutting unit. A transversely extending roll presses the dough sheet against the cutting unit to divide the dough sheet into a plurality of dough pieces that are held within hex-shaped openings formed in the cutting plates.

A retaining and releasing assembly is positioned above a center region of the cutting unit. The retaining and releasing assembly includes a plurality of retaining and releasing heads or tubes which are mounted to the cutting and packing apparatus for reciprocating movement through the openings in the cutting plates of the cutting unit. As the tubes move downward they contact the dough pieces retained within the openings in the cutting plates. Vacuum pressure through the tubes allows the tubes to retain the dough pieces as the tubes move through the openings in the cutting plates, thereby removing the dough pieces from the cutting unit. Continued downward movement causes the tubes to enter the open ends of containers positioned beneath the cutting unit. Air expelled from the tubes causes the dough pieces to be deposited in the containers. The length of the tubes are graduated such that the dough pieces are deposited in the bottoms of the containers at the start of the packing operation and near the tops of the containers at the end of the packing operation.

The containers are properly positioned for receiving the dough pieces by a plurality of pairs of laterally extending, horizontally disposed upper and lower flighted augers. Empty containers are delivered to a first end of the flighted augers by a first endless belt conveyor. A second endless belt conveyor removes filled containers from a second end of the flighted augers.

An electric drive motor is coupled to a first gear box which in turn is coupled to a second gear box by a first shaft. The second gear box is coupled to the cutting unit through a first mechanical intermittent drive. The first intermittent drive allows the cutting unit to move in a step-wise manner to position successive cutting plates beneath the retaining and releasing assembly. The drive motor is further coupled to a crank through a third gear box. The crank is connected to the retaining and releasing assembly, and thereby moves the tubes in a reciprocating fashion. The reciprocating movement of the tubes is synchronized with the step-wise movement of the cutting unit so that the cutting unit only moves when the tubes are not extending into or through the openings in the cutting plates. However, reciprocally operating the retaining and releasing assembly through a crank powered by a drive motor operating through a gear box slows the packing operation. In addition, the use of a pressure/vacuum blower along with accompanying ducts, pipes, manifold assembly used in combination with the retaining and releasing heads to transfer dough pieces from the cutting unit to containers further slows the packing process and is susceptible to malfunctioning.

It is evident that there is a continuing need for improved dough cutting and packing devices. In particular, there is a need for a dough cutting and packing apparatus which can efficiently transfer dough pieces from a cutting unit to containers without using a vacuum/pressure blower and accompanying hardware normally associated with prior art dough cutting and packing devices. In addition, the dough cutting and packing apparatus should be capable of transferring dough pieces from the cutting unit to containers at a high rate of speed.

SUMMARY OF THE INVENTION

The present invention is a dough cutting and packing apparatus. The dough cutting and packing apparatus includes an endless cutting unit having a plurality of cutting plates. The cutting plates have a plurality of dough retaining openings. The cutting unit is configured to receive a sheet of dough that is pressed into the cutting plates by a presser roller. This procedure divides the sheet of dough into dough pieces which are held within the dough retaining openings in the cutting plates of the cutting unit. These dough pieces are carried to a packing mechanism which includes a plurality of retaining and releasing heads.

The retaining and releasing heads are moved in a reciprocating fashion relative to the cutting unit by way of a microprocessor controlled servo motor. As the retaining and releasing heads move downward (i.e., through the packing stroke), they contact the dough pieces held within the retaining openings in the cutting plates. Operation of the servo motor during this packing stroke is in two stages. In the first stage, the servo motor rapidly accelerates the retaining and releasing heads at a rate in excess of the rate of acceleration of gravity. This causes the dough pieces to adhere to the retaining and releasing heads as the heads move through the openings in the cutting plates. Acceleration continues until the retaining and releasing heads enter open ends of containers positioned beneath the cutting unit. In the second stage of the packing stroke, the servo motor rapidly decelerates the retaining and releasing heads which discharges the dough pieces from the heads and deposits the dough pieces in the containers. At the end of the second stage of the packing stroke, movement of the retaining and releasing heads has ceased and the return stroke of the heads commences.

In the first stage of the return stroke of the retaining and releasing heads, the servo motor accelerates the heads out of the open ends of the containers and back through the openings in the cutting plates. In the second stage of the return stroke, the servo motor decelerates the retaining and releasing heads to a stop.

The containers are moved relative to the packing mechanism by a container positioning mechanism defined by a plurality of pairs of flighted augers such that the containers are intermittently stopped below respective retaining and releasing heads to allow the packing mechanism to transfer dough pieces from the cutting unit to the containers.

This dough cutting and packing apparatus is relatively uncomplicated. By providing the packing mechanism with a servo motor controlled by a programmable microprocessor, the dough cutting and packing apparatus can pack containers without the need of a pressure/-vacuum blower and accompanying ducts, pipes, manifold assembly and noise normally associated with prior art packing mechanisms. In addition, the microprocessor controlled servo motor permits the transfer of dough pieces from the cutting unit to containers to be accomplished efficiently and at a high rate of speed.

DETAILED DESCRIPTION OF THE PREFERRED EMBODIMENT

Figure 1:
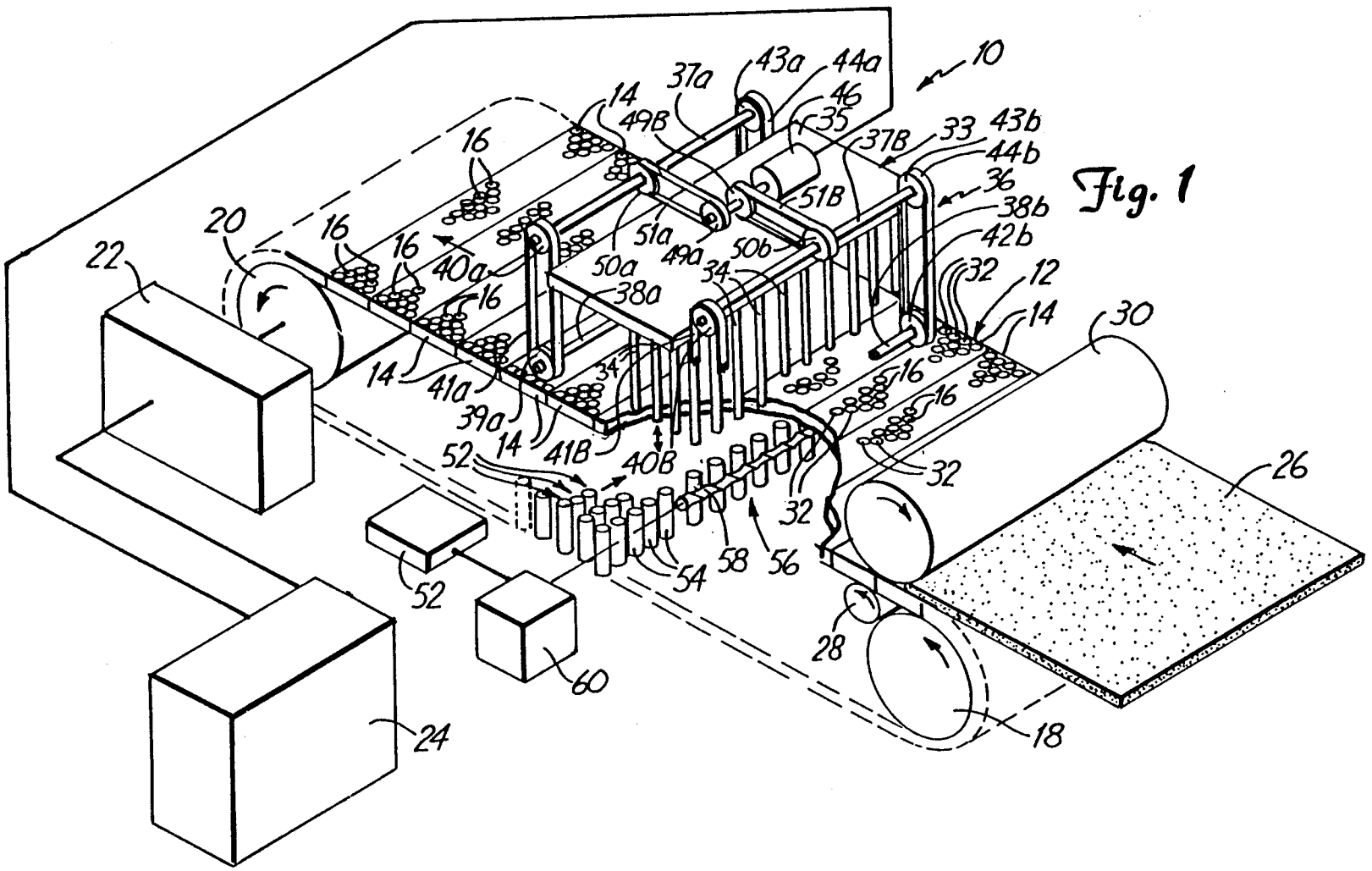
FIG. 1 is a perspective view of a dough cutting and packing apparatus in accordance with the present invention.

A dough cutting and packing apparatus 10 in accordance with the present invention is illustrated generally in FIG. 1. The cutting and packing apparatus 10 includes an endless cutting unit 12 having a plurality of interconnected cutting plates 14 (only some of which are shown in FIG. 1). Each of the cutting plates 14 includes a plurality of dough retaining openings 16. The dough retaining openings 16 are hexagonal in cross section and are typically referred to as hex-shaped. The cutting unit 12 extends about an idler element 18 and a drive element 20. The drive element 20 is coupled to a mechanical intermittent drive 22 which is driven by a first electric drive motor 24 through a gear box (not shown). The intermittent drive 22 causes the cutting unit 12 to be driven in a step-wise manner by the first drive motor 24.

A sheet of dough 26 merges with the cutting unit 12 adjacent the idler element 18. A support roller 28 positioned beneath the cutting plates 14, supports the cutting plates 14 as a presser roller 30 presses the sheet of dough 26 into the cutting plates 14 so that the sheet of dough 26 is divided into dough pieces 32 that are held within the retaining openings 16 in the cutting unit 12. The presser roller 30 is driven by friction as the sheet of dough 26 passes between the presser roller 30 and the cutting plates 14. The dough pieces 32 are carried by the cutting unit 12 away from the presser roller 30 to a position beneath a packing mechanism 33.

Figure 2:
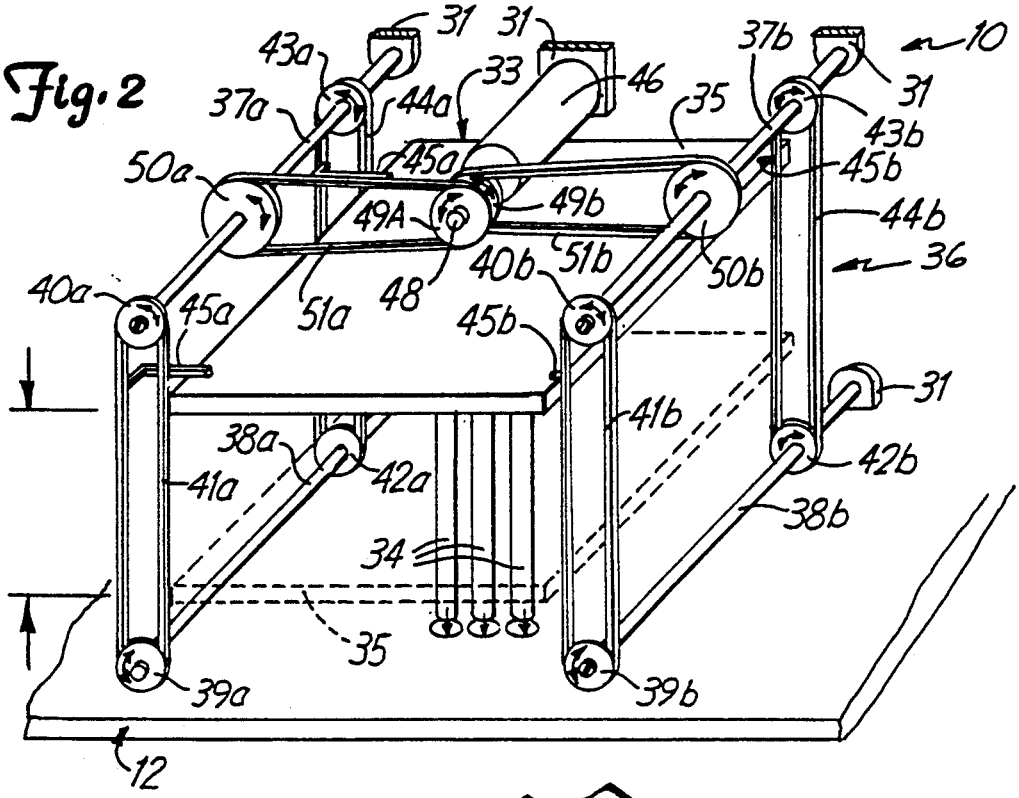
FIG. 2 is a perspective view showing a dough packing mechanism of the dough cutting and packing apparatus shown in FIG. 1.

As seen best in FIG. 2, the packing mechanism 33 includes a plurality of retaining and releasing heads or tubes 34 rigidly mounted to a support plate 35. The support plate 35 is driven in a reciprocating fashion by a packing mechanism drive assembly 36. The drive assembly 36 includes first and second, upper support shafts 37*a* and 37*b*, respectively, and first and second, lower support shafts 38*a* and 38*b*, respectively. Each support shaft 37*a*, 37*b*, 38*a* and 38*b* is rotatably supported at its opposite ends to a support frame 31 of the cutting and packing apparatus 10. For clarity, only the visible far end of the shafts 37*a*, 37*b* and 38*b* are shown in FIG. 2 as supported by the support frame 31.

As seen in FIG. 2, the first, lower support shaft 38*a* includes a rigidly fixed first idler gear 39*a* and the first, upper shaft 37*a* includes a rigidly fixed first drive gear 40*a*. A first toothed belt 41*a* couples the first idler gear 39*a* to the first drive gear 40*a*. In addition, the first, lower shaft 38*a* includes a rigidly fixed second idler gear 42*a* and the first, upper shaft 37*a* includes a rigidly fixed second drive gear 43*a*. A second toothed belt 44*a* couples the second idler gear 42*a* to the second drive gear 43*a*. The first and second belts 41*a* and 44*a* permit rotation of the first, upper shaft 37*a* to be transferred to the first, lower shaft 38*a* such that lower shaft 38*a* always rotates in the same direction as the upper shaft 37*a*. The support plate 35 is secured to the toothed belts 41*a* and 44*a* through connectors 45*a*.

Like the first, lower shaft 38*a*, the second lower shaft 38*b* includes rigidly fixed, first and second idler gears 39*b* and 42*b*, respectively. In addition, like the first, upper shaft 37*a*, the second, upper shaft 37*b* includes rigidly fixed, first and second drive gears 40*b* and 43*b*, respectively. A third toothed belt 41*b* couples the first idler gear 39*b* to the first drive gear 40*b* and a fourth toothed belt 44*b* couples the second idler gear 42*b* to the second drive gear 43*b*. The third and fourth belts 41*b* and 44*b* permit rotation of the second, upper shaft 37*b* to be transferred to the second, lower shaft 38*b* such that lower shaft 38*b* always rotates in the same direction as the upper shaft 37*b*. The support plate 35 is secured to the toothed belts 41*b* and 44*b* through connectors 45*b*.

As seen best in FIG. 2, the packing mechanism drive assembly 36 further includes an electric servo motor 46 which is rigidly mounted to the support frame 31 of the cutting and packing apparatus 10. The servo motor 46 includes a rotatable output shaft 48 having rigidly fixed, first and second drive sprockets 49*a* and 49*b*, respectively. The first drive sprocket 49*a* is coupled to an idler sprocket 50*a*, rigidly fixed to the first upper shaft 37*a*, through a fifth toothed belt 51*a*. Likewise, the second drive sprocket 49*b* is coupled to an idler sprocket 50*b*, rigidly fixed to the second upper shaft 37*b* , through a sixth toothed belt 51*b*. The servo motor 46 is coupled to a motion control module such as a programmable microprocessor 52. The programmable microprocessor 52 controls the rate at which the servo motor 46 operates and further controls stopping and starting of the servo motor 46.

Clockwise rotation (as viewed in FIG. 2) of the drive sprockets 49*a* and 49*b* via servo motor 46 causes clockwise rotation of the idler sprockets 50*a* and 50*b*, drive gears 40*a*, 43*a*, 40*b* and 43*b* and idler gears 39*a*, 42*a*, 39*b* and 42*b* and downward movement (i.e., a packing stroke) of the retaining and releasing heads 34. Likewise, counter-clockwise rotation (as viewed in FIG. 2) of the drive sprockets 49*a* and 49*b* via servo motor 46 causes counter-clockwise rotation of the idler sprockets 50*a* and 50*b*, drive gears 40*a*, 43*a*, 40*b* and 43*b* and idler gears 39*a*, 42*a*, 39*b* and 42*b* and upward movement (i.e., a return stroke) of the retaining and releasing heads 34.

Figure 3:
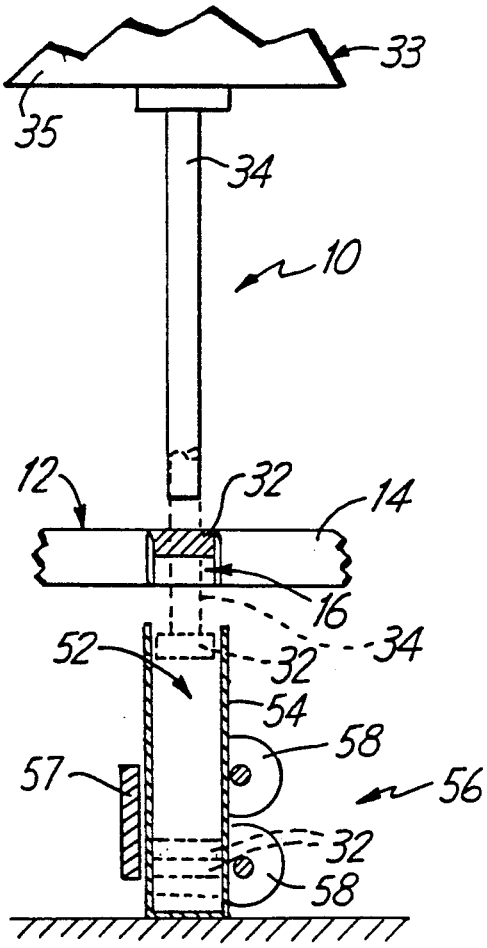
FIG. 3 is a side elevational view illustrating the operation of the packing mechanism shown in FIG. 2.

As seen in FIG. 3, reciprocating movement of the retaining and releasing heads 34 through operation of the servo motor 46 causes the heads 34 to pass through the openings 16 in the cutting plates 14. As the retaining and releasing heads 34 move downward (i.e., through the packing stroke), they contact the dough pieces 32 held within the retaining openings 16 in the cutting plates 14. Operation of the servo motor 46 during this packing stroke is in two stages. In the first stage, the servo motor 46 is rapidly accelerating the retaining and releasing heads 34 at a rate in excess of the rate of acceleration of gravity. This causes the dough pieces 32 to adhere to the retaining and releasing heads 34 as the heads 34 move through the openings 16 in the cutting plates 14. Acceleration continues until the retaining and releasing heads 34 enter open ends 52 of containers 54 positioned beneath the cutting unit 12. In the second stage of the packing stroke, the servo motor 46 rapidly decelerates the retaining and releasing heads 34 which allows the dough pieces 32 to leave the ends of the heads 34, since the dough pieces 32 are still traveling at the velocity of the heads 34 at the moment the servo motor 46 operation changes from acceleration to deceleration. This procedure causes the dough pieces 32 to be deposited in the containers 54. At the end of the second stage of the packing stroke, movement of the retaining and releasing heads 34 has ceased and the return stroke of the heads 34 commences.

In the first stage of the return stroke of the retaining and releasing heads 34, the servo motor 46 is accelerating the heads 34 as the heads 34 move out of the open ends 52 of the containers 54 and back through the openings 16 in the cutting plates 14. In the second stage of the return stroke, the servo motor 46 decelerates the retaining and releasing heads 34 to a stop. At this point, there is no movement (known as dwell time) in the packing mechanism 33 until the cutting unit 12 advances thereby readying the packing mechanism 33 for the next packing stroke. Typically in practice, the return stroke of the packing mechanism 33 takes less time than the packing stroke.

Preferably in operation, during the first stage of the packing stroke, the servo motor 46 accelerates the retaining and releasing heads 34 at a rate of approximately 1206 in./sec.$^2$ (3.1 g.) to a terminal velocity of 145 in./sec. in approximately 0.120 sec. Preferably in the second stage of the packing stroke, the servo motor 46 decelerates the retaining and releasing heads 34 at a rate of approximately 4523 in./sec.$^2$ (11.7 g.) to zero velocity in approximately 0.032.

Preferably in operation, during the first stage of the return stroke, the servo motor 46 accelerates the retaining and releasing heads 34 at a rate of approximately 2245 in./sec.$^2$ (5.8 g.) to a terminal velocity of 57 in./sec. in approximately 0.070 sec. Preferably in the second stage of the return stroke, the servo motor 46 decelerates the retaining and releasing heads 34 at a rate of approximately 2245 in./sec.$^2$ (5.8 g.) to zero velocity in approximately 0.070 sec. Preferably, dwell time for the packing mechanism 33 until the next packing stroke is approximately 0.208 sec.

The length of the heads 34 are graduated such that the dough pieces 32 are deposited in the bottoms of the containers 54 at the start of the packing operation and near the tops of the containers 54 at the end of the packing operation. The reciprocating movement of the retaining and releasing heads 34 is synchronized with the step-wise movement of the cutting unit 12 so that the cutting unit 12 only moves when the heads 34 are not extending into or through the retaining openings 16 in the cutting plates 14.

As seen in FIG. 1, the containers 54 are properly positioned for receiving the dough pieces 32 by a container positioning mechanism 56 defined by guide rails 57 (see FIG. 2) and a plurality of pairs of laterally extending, horizontally disposed upper and lower flighted augers 58 that engage the containers 54. The container positioning mechanism 56 is described in U.S. patent application Ser. No. 07/776,900, DOUGH CUTTING AND PACKING APPARATUS, filed on Oct. 16, 1991, which is a Continuation of U.S. patent application Ser. No. 07/521,734, DOUGH CUTTING AND PACKING APPARATUS, filed on May 10, 1990, which are hereby incorporated herein by reference thereto. The container positioning mechanism 56 is positioned beneath the cutting unit 12 and the packing mechanism 33 so that the containers 54 are positioned in aligned registry with retaining and releasing heads 34. Empty containers 54 are delivered to a first end of the flighted augers 58 by a first endless belt conveyor (not shown). A second endless belt conveyor (not shown) removes filled containers 54 from a second end of the flighted augers 58.

Figure 4:
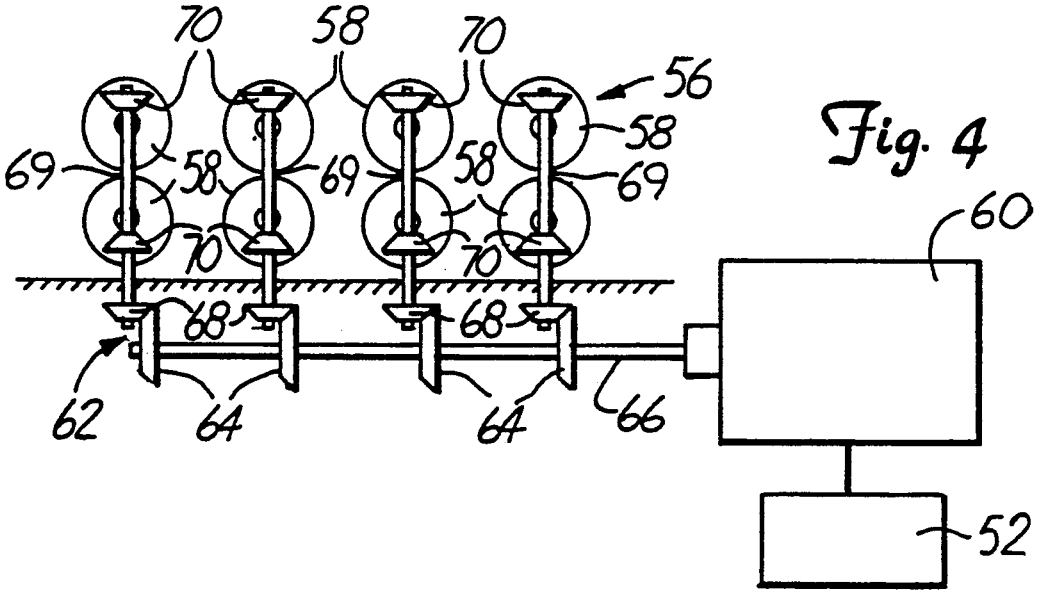
FIG. 4 is a side elevational view showing the particulars of a container positioning mechanism of the dough cutting and packing apparatus shown in FIG. 1.

As seen in FIGS. 1 and 4, the flighted augers 58 of the container positioning mechanism 56 are driven by a second electric drive motor such as an electronic stepper motor 60 through a beveled gear mechanism 62. The beveled gear mechanism 62 includes a plurality of first beveled gears 64 fixed to a drive shaft 66 of the stepper motor 60. The first beveled gears 64 engage a plurality of second beveled gears 68 mounted on input shafts 69. The input shafts 69 include a plurality of third beveled gears 70 that engage and thereby transfer power to the flighted augers 58.

The stepper motor 60 is coupled to the programmable microprocessor 52. The programmable microprocessor 52 controls the rate at which the stepper motor 60 operates and further controls stopping and starting of the stepper motor 60. The stepper motor 60 is capable of operating at a wide range of gear ratios to allow the containers 54 to be driven such that they bypass selected retaining and releasing heads 34. In addition, the stepper motor 60 can operate as a skip indexing mechanism by programming the microprocessor 52 to allow more than one dough piece 32 to be deposited in the containers 54 at each of the retaining and releasing heads 34. The stepper motor 60 is synchronized with the first drive motor 24 such that the containers 54 are only moved when the retaining and releasing heads 34 do not extend into or through the retaining openings 16 of the cutting unit 12.

The dough cutting and packing apparatus 10 is relatively uncomplicated. By providing the packing mechanism 33 with a servo motor 46 controlled by a programmable microprocessor 52, the dough cutting and packing apparatus 10 can pack containers without the need of a pressure/vacuum blower and accompanying ducts, pipes, manifold assembly and noise normally associated with prior art packing mechanisms. In addition, the microprocessor controlled servo motor permits the transfer of dough pieces 32 from the cutting unit 12 to containers 54 to be accomplished efficiently and at a high rate of speed.

Although the present invention has been described with reference to preferred embodiments, workers skilled in the art will recognize that changes may be made in form and detail without departing from the spirit and scope of the invention.

What is claimed is:

1. In a dough cutting and packing apparatus of the type including a movable, endless cutting unit and a rotatable member for pressing a dough strip against the cutting unit to divide the dough strip into a plurality of dough pieces, the dough pieces being retained within a plurality of openings in the endless cutting unit, and further having a packing mechanism positioned above the endless cutting unit and configured to reciprocate through the openings in the cutting unit for removing the dough pieces from the openings, and a container positioning mechanism for moving a plurality of containers relative to the packing mechanism such that the containers are advanced from a position aligned with a first set of openings to successive positions aligned with successive sets of openings to allow the packing mechanism to transfer dough pieces from the cutting unit to the containers until the containers are filled, the improvement which comprises:

a drive assembly coupled to the packing mechanism and operable to move the packing mechanism through a packing stroke wherein the dough pieces are transferred from the cutting unit to the containers, the drive assembly accelerating the packing mechanism at a rate greater than the rate of acceleration of gravity for at least a portion of the packing stroke.

2. The dough cutting and packing apparatus of claim 1 wherein the drive assembly includes a drive motor for powering the packing mechanism, and wherein the drive motor is operable to move the packing mechanism through a return stroke such that the packing mechanism is readied for a successive packing stroke, the drive motor accelerating the packing mechanism for at least a portion of the return stroke.

3. The dough cutting and packing apparatus of claim 2, and further including a motion control unit coupled to the drive motor for controlling the movement of the packing mechanism throughout the packing and return strokes.

4. The dough cutting and packing apparatus of claim 3 wherein the motion control unit is a programmable microprocessor, and wherein the microprocessor is further coupled to a drive unit of the cutting unit to control operation thereof such that the packing mechanism and the cutting unit operate in a synchronized manner.

5. The dough cutting and packing apparatus of claim 2 wherein the drive motor is a servo motor.

6. A dough cutting and packing apparatus for dividing a dough strip into a plurality of dough pieces and for packing the dough pieces into a plurality of containers, the apparatus comprising:

an endless cutting unit including:

a plurality of dough piece retaining openings; and a first drive unit;

a presser roll adjacent a first end of the endless cutting unit for pressing the dough strip against the cutting unit to divide the dough strip into the plurality of dough pieces that are held within the dough piece retaining openings of the cutting unit;

a packing mechanism positioned above a center region of the endless cutting unit and including:

a plurality of retaining and releasing heads, the heads being in aligned registry with the dough retaining openings in the cutting unit; and a drive assembly including:

a drive motor coupled to the retaining and releasing heads and operable to move the heads through a packing stroke, wherein the dough pieces are transferred from the dough piece retaining openings to the plurality of containers, and a return stroke wherein the heads are readied for a successive packing stroke, the drive motor accelerating the heads at a rate greater than the acceleration of gravity to maintain the dough pieces on the heads for at least a portion of the packing stroke; and a container positioning mechanism positioned below the center region of the endless cutting unit and including: an auger conveyor; and a second drive unit.

7. The cutting and packing apparatus of claim 6, and further including a motion control unit coupled to the drive motor for controlling the movement of the packing mechanism throughout the packing and return strokes.

8. The cutting and packing apparatus of claim 7 wherein the motion control unit is a programmable microprocessor, and wherein the microprocessor is further coupled to a drive unit of the cutting unit to control operation thereof such that the packing mechanism and the cutting unit operate in a synchronized manner.

9. The cutting and packing apparatus of claim 6 wherein the drive motor is a servo motor.

10. The cutting and packing apparatus of claim 6 wherein each of the packing and return strokes includes an acceleration stage and a deceleration stage.

11. The cutting and packing apparatus of claim 10 wherein the acceleration stage of the packing stroke is greater then the deceleration stage of the packing stroke, and wherein the acceleration stage of the return stroke is substantially equal to the deceleration stage of the return stroke.

12. The cutting and packing apparatus of claim 6 wherein the packing mechanism drive assembly further includes:

at least one rotatable upper shaft;

at least one rotatable lower shaft;

at least one idler belt coupling the upper shaft to the lower shaft for simultaneous rotation, the retaining and releasing heads being coupled to the idler belt; and at least one drive belt coupling the drive motor to one of the upper and lower shafts to rotate the shafts and move the heads between the packing and return strokes.

* * * * *